US005806972A

United States Patent [19]

Kaiser et al.

[11] Patent Number: 5,806,972

[45] Date of Patent: Sep. 15, 1998

[54] LIGHT TRAP AND LOUVER MOUNTING TO FLUORESCENT TROFFER LIGHTING FIXTURE

[75] Inventors: Jeffrey Wayne Kaiser, Snellville; Peter Michael Schmidt, Conyers; Roger Erle Norris, Covington, all of Ga.

[73] Assignee: National Service Industries, Inc., Atlanta, Ga.

[21] Appl. No.: 735,090

[22] Filed: Oct. 21, 1996

[51] Int. Cl.[6] ..... F21V 17/02

[52] U.S. Cl. ..... 362/290; 362/354

[58] Field of Search ..... 362/290, 291, 362/292, 342, 354, 217, 330

[56] References Cited

U.S. PATENT DOCUMENTS

| | | | |
|---|---|---|---|
| 2,852,663 | 9/1958 | Stuffer et al. | 362/354 |
| 3,219,813 | 11/1965 | Peck | 362/354 |
| 4,268,897 | 5/1981 | Schierwagen et al. | 362/290 |
| 4,429,354 | 1/1984 | Garnett | 362/342 |
| 4,471,596 | 9/1984 | Deaton et al. | 362/354 |
| 4,494,175 | 1/1985 | Gawad et al. | 362/290 |
| 4,630,181 | 12/1986 | Fain et al. | 362/342 |
| 4,729,075 | 3/1988 | Brass | 362/290 |
| 4,751,626 | 6/1988 | Plewman | 362/290 |
| 4,849,867 | 7/1989 | Glass et al. | 362/342 |
| 5,383,102 | 1/1995 | Jones | 362/354 |
| 5,505,904 | 4/1996 | Haidinger et al. | 422/24 |

*Primary Examiner*—Alan Cariaso
*Attorney, Agent, or Firm*—Kenneth E. Darnell

[57] ABSTRACT

An improved light trap and louver mounting assembly particularly intended to be used as a component of a fluorescent troffer lighting fixture, the invention comprises a light trap structure formed with integral fastening elements which attach component parts of the light trap together, which attach the light trap to the louver and which releasably mount the light trap and louver mounting assembly to a housing assembly of the lighting fixture. The integral fastening elements of the invention act to provide the aforesaid functions without the use of separate fastening elements such as screws, hinges, latches and the like. The light trap and louver mounting assembly of the invention is structurally rigid and imparts desirable rigidity to the louver and to the lighting fixture.

26 Claims, 11 Drawing Sheets

LIGHT TRAP AND LOUVER MOUNTING TO FLUORESCENT TROFFER LIGHTING FIXTURE

BACKGROUND OF THE INVENTION

1. Field of the Invention

The invention relates generally to fluorescent troffer lighting fixtures and particularly to a louvered fixture having a light trap and louver mounting assembly which releasably fastens together the component parts of the light trap and which further releasably mounts a louver to a fixture housing assembly.

2. Description of the Prior Art

Fluorescent lighting has long been commonplace especially in commercial, institutional and industrial applications, the energy efficiency of fluorescent fixtures coupled with relatively low fixture costs causing fluorescent lighting to be the lighting of choice in most office situations as well as in numerous other task lighting applications inter alia. Parabolic-louvered troffers now set the standard in architectural lighting for most commercial and institutional applications. In such applications as in a commercial office building, literally thousands of fluorescent troffer lighting fixtures are mounted by suspended ceiling grid arrangements not only for lighting performance but also for pleasing appearance. Surface-mounted troffer fixtures also exist with similar performance features. In varying fluorescent applications, troffer fixtures have become essential components of the very architecture of high activity environments with commercial lighting systems finding particular utility in such environments. Within this context, the need has increased in the industry to provide fixtures which can be manufactured at minimum cost yet exhibit exceptionally high performance and further provide an appearance which allows the substitution of such fixtures into fluorescent fixture arrangements such that no visible change in shape or appearance is apparent to a user. Further, these low-cost, high performance fixtures must be rapidly installable and must yield ever-increasing energy efficiencies while producing desired illuminance levels. Contemporary lighting systems and particularly parabolic troffer systems must therefore provide a marriage of aesthetics and performance at minimum manufacturing costs. Since manufacturing costs can become a particular consideration in certain markets, those troffer fixtures requiring various combinations of hinging, latching and fastening through the use of separate fastening elements are expensive due to complexity. Cost reductions become essential in the art and are often brought about through material choices for louver fabrication and thinner materials for louver and fixture body fabrication to name but a few. Additional economies are seen to be available from a design of a fixture body assembly to avoid the use of separate fastening elements in the manufacture of such an assembly. Forming structural portions of a fixture body assembly with integral fastening elements allows snap-fit assembly without the need for screws or the like which must be procured separately and separately brought to an assembly location. Fasteners such as screws are also difficult to work with in assembly situations due to their size and due to the usual necessity for manual placement and manipulation of the fastener. In such situations, a tool is required to secure the fastener to the structural elements of the fixture which must be joined together quickly and with precision.

An example of a fluorescent louvered lighting fixture is seen in U.S. Pat. No. 4,494,175 to Gawad et al. Gawad et al disclose a mounting arrangement for supporting a louver to a suspended grid with a fixture body assembly associated with the fixture being essentially separately mounted on said grid. Fluorescent louvered lighting fixtures available in the industry further utilize screws and other fasteners to join a light trap structure to a louver and/or a louver to a fixture housing of a louvered lighting fixture. These prior assembly practices represent the structure and methodology upon which the present invention intends improvement.

Examples of conventional light trap devices can be found in U.S. Pat. Nos. 4,630,181 to Fain et al and 5,505,904 to Haidinger et al. Fain et al describe a light trap device as comprising a pair of side rails 36 and a pair of end rails 38 which comprise in combination a substantially rectangular light trap of a conventional construction which prevents downward escape of light from around peripheral edges of a louver 66. The side rails 36 and the end rails 38 block light simply by abutment against peripheral edges of the louver 66 and thus the light trap of Fain et al, which is referred to as a door frame 32 in the Fain et al patent, acts in a conventional manner to provide a desired light "trapping" function. Haidinger et al describe a conventional light trap which takes the form of a felt gasket disposed between and/or against portions of a lighting fixture between which light can "leak". In essence, the felt gasket of Haidinger et al functions to block light as does the light trap described by Fain et al.

The invention thus provides a light trap and louver mounting assembly particularly intended for rapid assembly with and disassembly from a housing assembly of a fluorescent louvered lighting fixture. The light trap of the invention is formed with integral fastening elements which not only hold component parts of the light trap together but which also hold the light trap to a louver in order to form a light trap and louver mounting assembly, fastening elements formed integrally with the light trap further acting to releasably mount the light trap and louver mounting assembly to a housing assembly of a louvered parabolic troffer without the requirement for separate fasteners. According to the invention, the structural body elements forming the light trap are formed with fastening elements which are integral with said body elements, thereby avoiding the cost of separate fasteners and the difficulty of working with such fasteners. The invention as practiced yields material cost savings as well as assembly cost savings while providing a lighting fixture having excellent mechanical rigidity, the rigidity and stability of the lighting fixture brought about by the mechanical structure thereof also contributing to overall fixture lighting performance. The advantages of the invention occur with the retention of traditional and necessary functions.

SUMMARY OF THE INVENTION

The present invention provides a fluorescent troffer lighting fixture and particularly a light trap and louver mounting assembly which can be assembled from component parts amenable to automated fabrication. The light trap and louver mounting assembly is assembled to a louver without the use of separate fasteners to form a light trap and louver mounting assembly which is characterized by simplicity and economy of construction. The light trap imparts rigidity to the louver thereby causing the lighting fixture of the invention to display unusually precise light control through maintenance of the desired parabolic contours of the louver when in an assembled relationship with a housing assembly of the lighting fixture of the invention. Available light is thus concentrated into those photometric zones most crucial to user comfort and efficiency. The rugged and rigid construction of the light trap and louver assembly as well as of the lighting fixture per se permits maintenance of desired body contours during handling and use after assembly. The rigidity of the light trap and louver mounting assembly as well as the rugged construction thereof causes precision contours of the louver to remain in place relative to each other when mounted to a housing assembly of the present lighting fixture, thereby providing excellent lighting performance. The precise fitting of the component parts of the light trap to the louver eliminates light leaks which would otherwise be visible from the interior of the present fixture.

The light trap and louver mounting mechanism of the invention can be rapidly assembled from component parts capable of automated fabrication. These component parts include cooperating fastening elements formed integrally with the component parts, the integral fastening elements permitting inordinately rapid and ready assembly of the component parts to form the light trap and louver assembly. The integral fastening elements are configured to allow snap-fastening of the component parts together in a manner which assures a locking together of said component parts which is reliable and precise. The light trap and louver assembly configured according to the invention is therefore capable of rapid and easy assembly without the use of separate fastening elements. The releasable mounting of the light trap and louver mounting assembly to a housing assembly of the present lighting fixture adds safety to an installation of said lighting fixture, the structure being incapable of accidental or inadvertent loss of structural integrity in an installation. Precise fixture configuration is assured according to the invention even though the component parts of the light trap and louver mounting assembly are joined together rapidly in a mass assembly environment with snap-fitting fastening elements formed integrally with said component parts. Economies of fabrication and assembly are thereby realized with no sacrifice of fixture performance.

Accordingly, it is an object of the invention to provide a light trap and louver mounting assembly for a louvered lighting fixture such as a fluorescent parabolic troffer fixture and which is capable of superior mechanical and lighting efficiency even though the lighting fixture is simply and ruggedly constructed and is capable of being rapidly assembled from component parts which can be fabricated using standard automated fabrication techniques.

It is another object of the invention to provide a lighting fixture and particularly a louvered lighting fixture such as a fluorescent parabolic troffer fixture which can be assembled through the expedient of fastening elements formed integrally with component parts of a light trap and louver mounting assembly, the light trap and louver mounting assembly thus being capable of rapid and economical assembly from component parts which can be fabricated using standard automated fabrication techniques.

It is yet another object of the invention to provide a lighting fixture and particularly a louvered lighting fixture such as a fluorescent parabolic troffer fixture having a light trap and louver mounting assembly which can be rapidly and efficiently assembled without the need for separate fasteners.

Further objects and advantages of the invention will become more readily apparent in light of the following detailed description of the preferred embodiments.

DESCRIPTION OF THE PREFERRED EMBODIMENTS

Reference is made to co-pending United States patent application Ser. No. 08/731,826 entitled "Fluorescent Troffer Lighting Fixture", assigned to the present assignee and filed of even date, the disclosure of said patent application being incorporated hereinto by reference.

Figure 1:
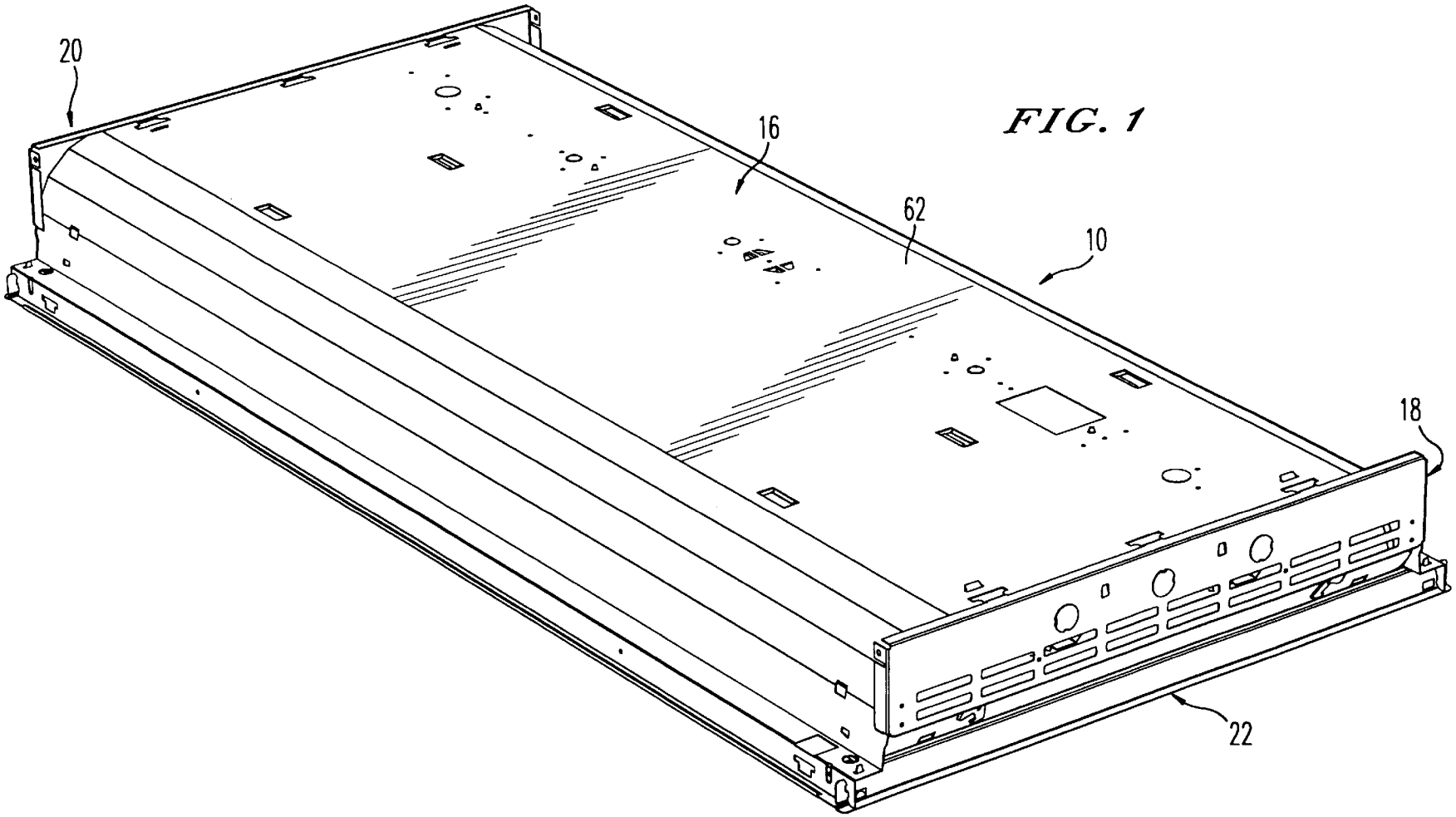
FIG. 1 is a perspective view of a lighting fixture provided with a light trap and louver mounting assembly configured according to the invention and taken from above and toward one end of the fixture.
Figure 2:
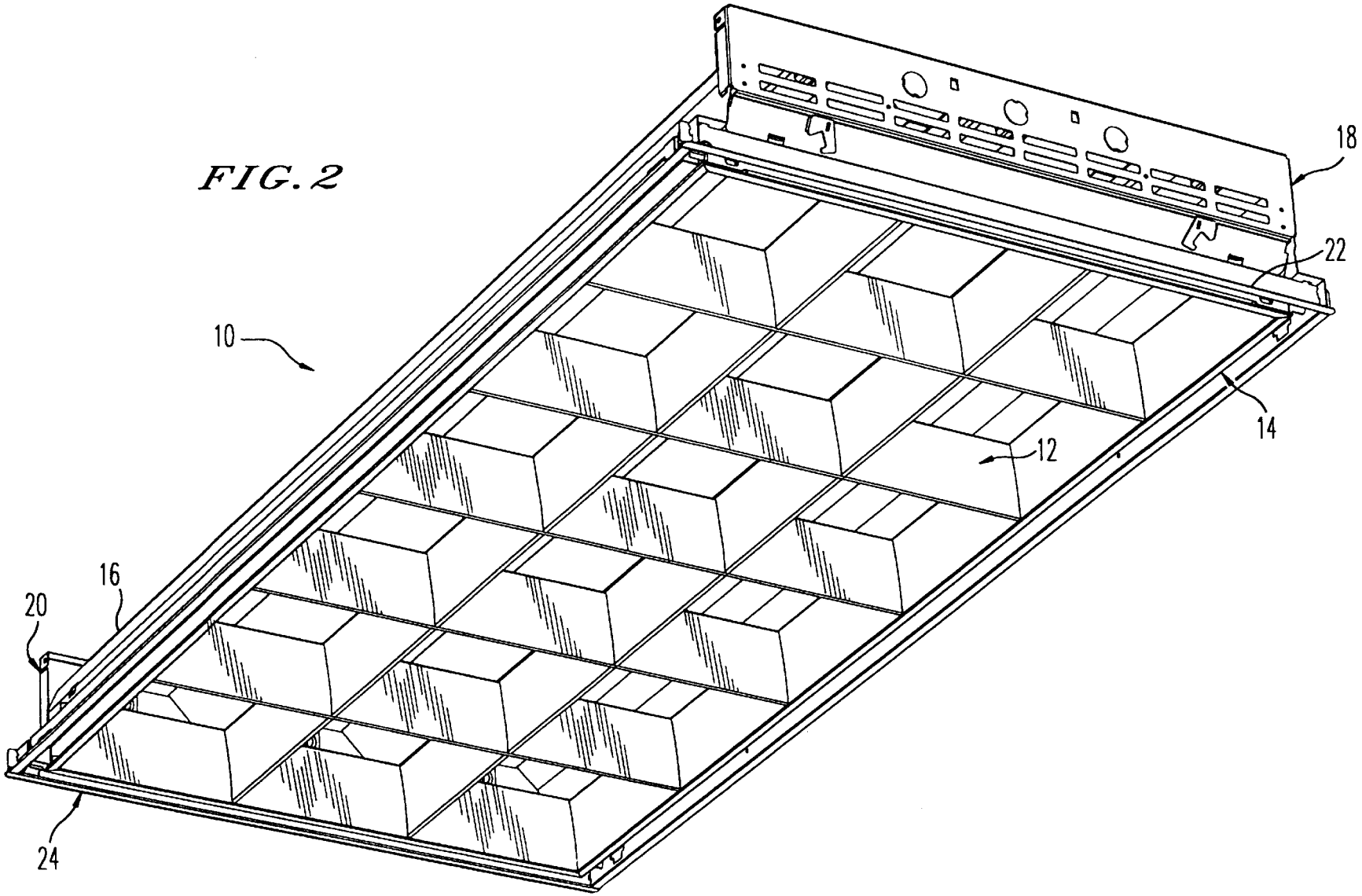
FIG. 2 is a perspective view of the lighting fixture of FIG. 1 taken from below and toward an end of said fixture.
Figure 3:
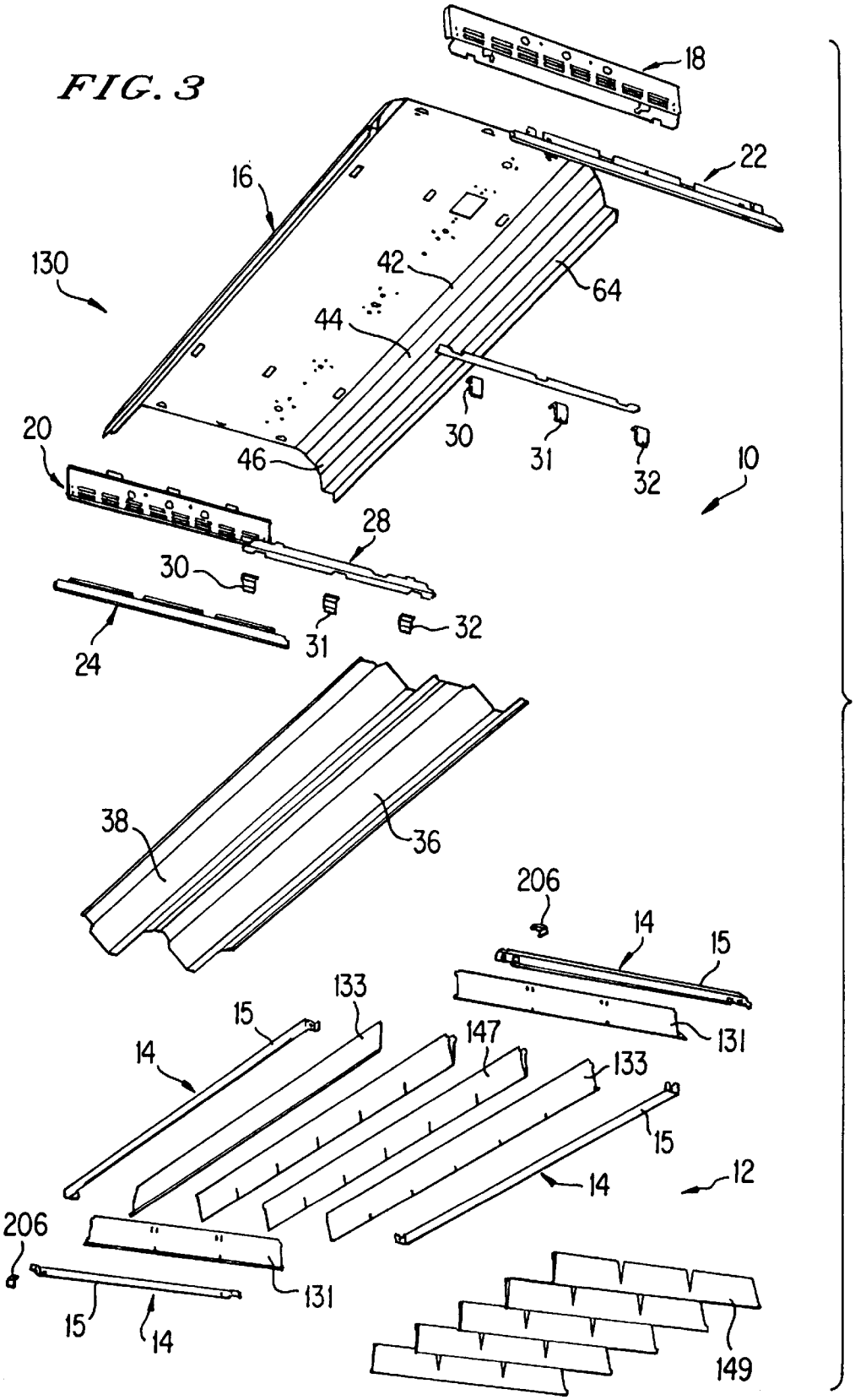
FIG. 3 is an exploded assembly view of the lighting fixture of FIGS. 1 and 2.

Referring now to the drawings and particularly to FIGS. 1 through 3, a lighting fixture configured according to the invention is seen generally at 10, the fixture 10 as shown being a troffer fixture intended to mount elongated fluorescent lamps as will be described hereinafter. The fixture 10 is provided with a louver 12 on the "underside" of the fixture, the louver 12 being positively mounted to housing 16 of the fixture 10 by means of a combined light trap and louver mounting assembly 14. The assembly 14 comprises light trap 15 which is formed of component parts including snap-fitting fastening elements to be described hereinafter. The fastening elements formed integrally with component parts of the light trap 15 act to assemble the light trap 15 to the louver 12. Further, the fastening elements formed integrally with the component parts of the light trap 15 act to releasably mount light trap and louver mounting assembly 14 to housing assembly 130 as is disclosed in detail herein and also in the aforesaid co-pending United States patent application which is incorporated hereinto by reference. The housing 16 has respective end plates 18 and 20 connected respectively to open ends of the housing 16. Immediately below the end plate 18 is a side bar 22 which joins directly to the housing 16 at the end thereof and also to portions of the end plate 18. Similarly, a side bar 24 is located immediately below the end plate 20 and connects to the housing 16 and to the end plate 20. A socket strip 26 is located at that end of the housing 16 to which the end plate 18 is attached, a virtually identical socket strip 28 being similarly disposed at the opposite end of the housing 16. The socket strips 26 and 28 respectively mount lamp sockets 30, 31 and 32, the sockets 30, 31 and 32 receiving elongated fluorescent lamps (not shown) in a known manner. The socket strip 28 essentially differs from the socket strip 26 by the provision of a different number of cutouts used for management of wiring (not shown) in the strip 28 as is described in the aforesaid patent application. Lamp channels 36 and 38 mount within the interior of the housing 16, the channels 36 and 38 being shaped to continue the parabolic shape of the louver 12 thereby to respectively envelop fluorescent lamps (not shown) in substantially fully reflective cavities which are also partially formed by surfaces of the housing 16 adjacent to the lamp channels 36, 38 as is described in the aforesaid co-pending patent application.

While the lighting fixture 10 is shown as comprising a recessed fixture which can be conveniently and conventionally mounted to suspended ceilings such as are formed of spaced grid elements, it is to be understood that at least certain features of the fixture 10 can be employed in the construction of a surface-mounted lighting fixture of the parabolic troffer type. Still further, while the lighting fixture 10 is seen to mount three elongated fluorescent lamps (not shown), it is to be understood that lighting fixtures configured according to the invention and comprising the light trap and louver mounting assembly 14 can be formed to have more or less than three lamps as is also conventional in the art. Of substantial importance in a consideration of the structure of lighting fixture 10 is the fact that the fixture 10 as configured provides no visible change in shape or appearance to a user when compared to at least certain presently available fixtures of similar kind. It is also to be understood that the lighting fixture 10 of the invention as described herein can be economically produced at a cost which is relatively low when compared to presently available lighting fixtures of similar kind, appearance and performance.

As indicated hereinabove, the lighting fixture 10 can be rapidly assembled from component parts produced by automated fabrication techniques, assembly being possible without the use of additional hardware including fasteners and the like which are separate elements normally requiring the use of tools and requiring manual manipulation in an assembly situation. While the lighting fixture 10 of the invention can be assembled by means of fastening elements integrally formed with component parts of said fixture 10 and particularly of said light trap and louver mounting assembly 14, the structure of the fixture 10 exhibits unexpected rigidity due to the fact that the component parts of the fixture 10 are positively secured together by means of the several integral fastening elements formed on component parts of said fixture. All mechanical structure forming the lighting fixture 10 is snap-fit together and held by the integral fastening elements formed with the several component parts of said fixture with the exception of ballast structure which is described in the co-pending patent application referred to hereinabove. The light trap 15 particularly mounts to and about the louver 12 to impart rigidity to the louver 12 and to form the light trap and louver mounting assembly 14. The assembly includes the structure of the light trap 15 and the assembly 14 is snap-fit to the housing assembly 130 by means of the resilient springs 206 as will be described herein.

Figure 4:
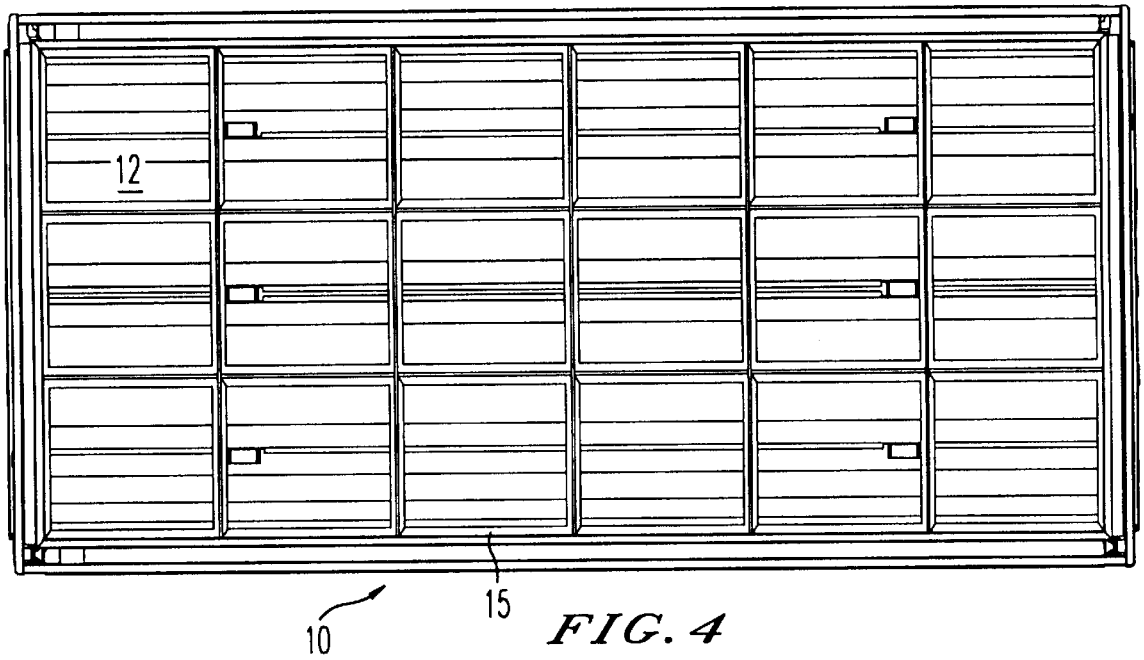
FIG. 4 is a bottom view of the lighting fixture of FIGS. 1 through 3.
Figure 5A:
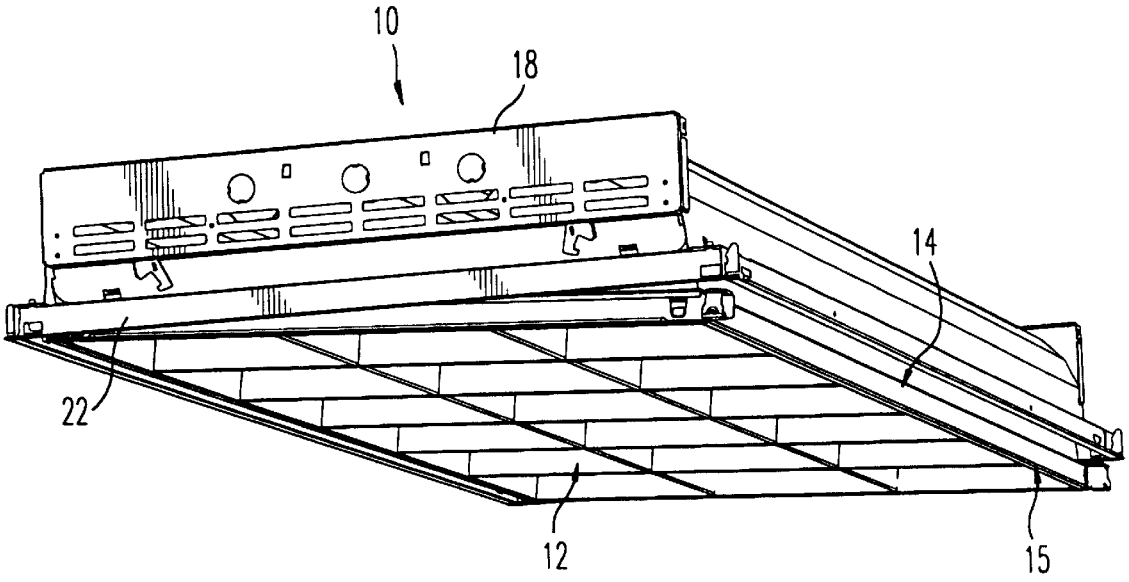
FIGS. 5A and 5B are related perspective and detail views of a snap release mechanism which allows rapid assembly and disassembly of the light trap and louver mounting assembly of the invention to a housing assembly of the fixture illustrating the position of light trap and louver mounting assembly immediately before snap-fitting of said assembly to the housing assembly.
Figure 5B:
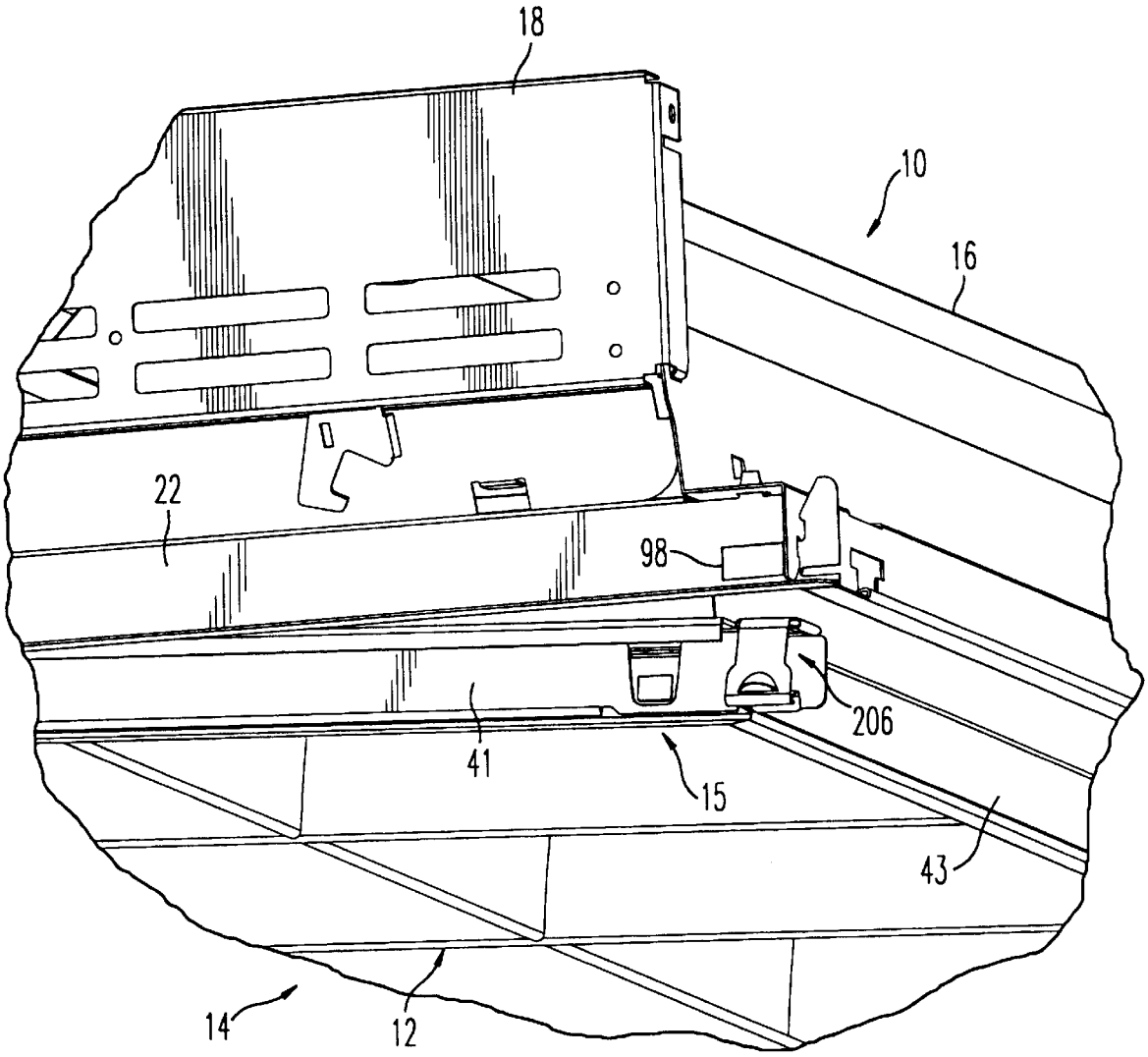
Figure 6A:
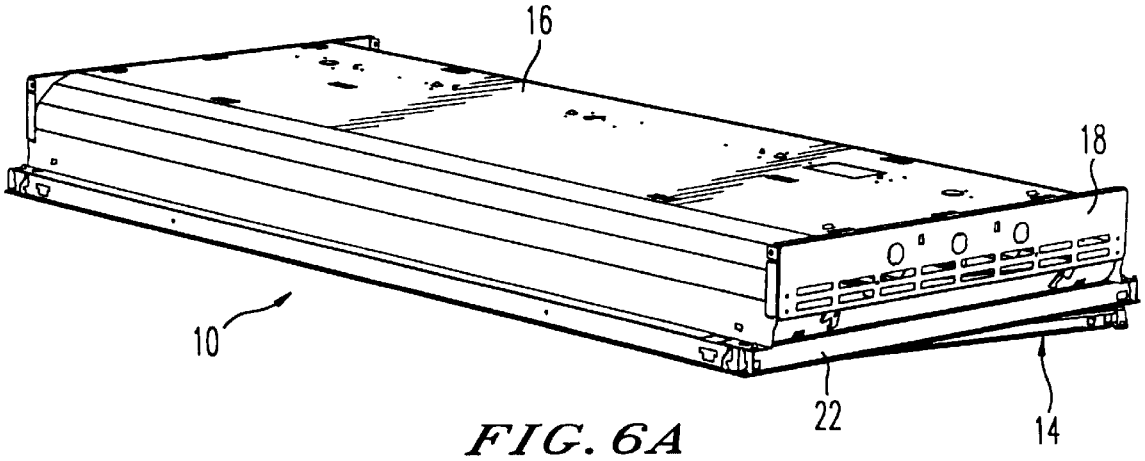
FIGS. 6A and 6B are related perspective and detail views of a passive connection of a side of the light trap and louver mounting assembly opposite the snap-fitting mechanism shown in FIG. 5 inclusive.
Figure 6B:
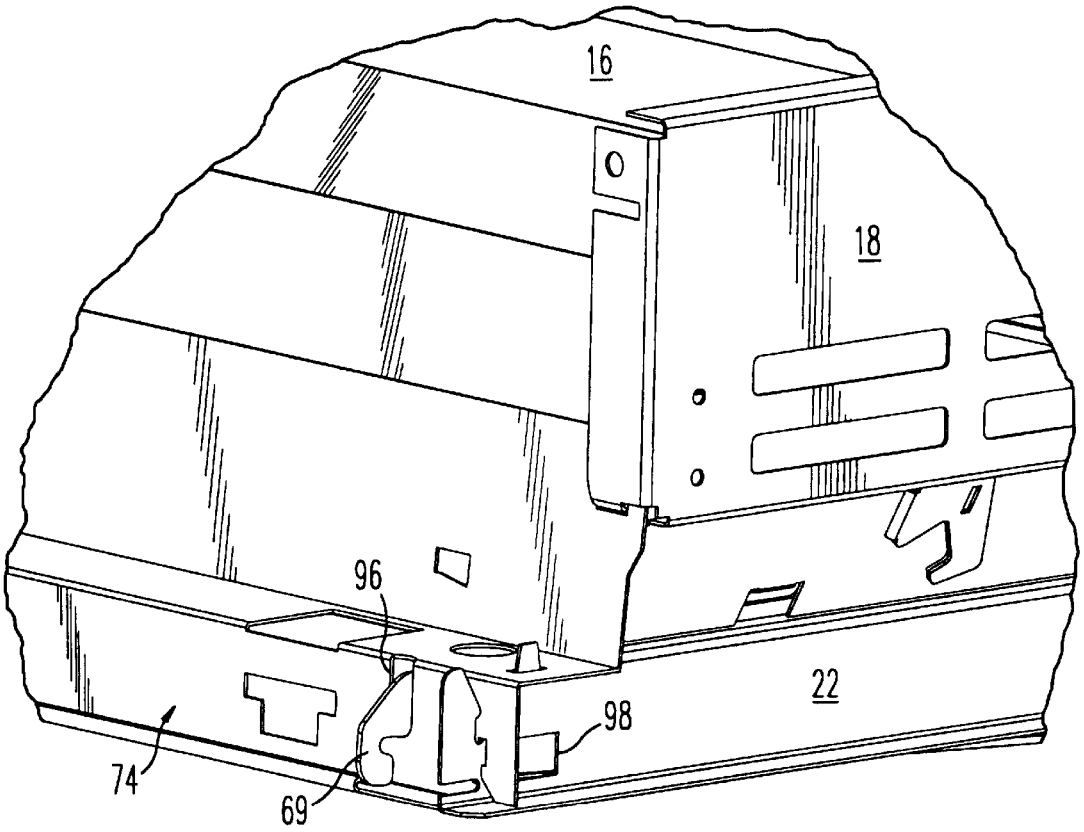

Referring now to FIGS. 4 and 5A and 5B inter alia, the light trap 15 can be seen to be assembled about the lower periphery of the louver 12, the light trap 15 lying snugly aginst said louver 12 throughout the entire louver periphery in order to prevent leakage of light through the louver 12. The light trap 15 is comprised of two minor side frames 41 and two major side frames 43, these four structural elements being joined together at respective ends thereof to form the rectangular light trap 15. As is best seen in FIG. 8 inclusive and also in FIGS. 10 through 12, each of the minor side frames 41 are formed of an L-shaped channel 45 having a horizontal flange 47 and a vertical flange 49. The two minor side frames 41 are essentially mirror images of each other with a right hand and a left hand frame 41 comprisng the assembly 14. However, a description of one of the side frames 41 will suffice for a description of the other side frame 41. The free lateral edge of the horizontal flange 47 terminates in a downwardly directed edge flange element 51 which is substantially planar, the plane of the element 51 being substantially perpendicular to the plane of the horizontal flange 47. The vertical flange 49 is provided along a medial portion the length of a free edge thereof with an edge flange element 53. At the respective ends of the edge flange element 53 slots 55 are formed in the vertical flange 49, the slots 55 being open on that side thereof which would coincide with the lower free edge of the vertical flange 49. Immediately outwardly of each of the slots 55 at the ends 57 and 59 are U-shaped apertures 61 from which tabs 63 have been stamped, the base of each tab 63 curving from that edge attached to the vertical flange 49. Each tab 63 has a substantially planar central portion which then curves along an outer edge to form a distal planar edge flange 65. The body of each of the tabs 63 is spaced from the plane of the vertical flange 49, the edge flange 65 being a greater distance from the plane of the vertical flange 49 than is the central body portion of the tab 63 due to slanting of the tab 63 away from the body of said flange 49. At the end 57 of the side frame 41, the vertical flange 49 bends at a 90° angle to form side flange 67, the side flange 67 then recurving to a 90° bend to form J-shaped hook element 69. The hook element 69 has a centering tab 71 formed along an upper edge thereof to facilitate mounting of the light trap 15 to the louver 12. The hook element 69 is formed with a slot 73 having a complex shape, the slot 73 being open along lowermost edges thereof and forming a rounded outer end defined by bight portion 23 of the J-shaped hook element 69. At its inner end, the slot 73 is defined by a slanted lead-in edge 75. The hook elements 69 on each of the minor side frames 41 are inserted respectively into one of the slots 96 formed in vertical flange 74 of the housing 16 as is shown and described in the co-pending United States patent application referred to hereinabove. Since a pair of the slots 96 are formed in both of the vertical flanges 74 on each side of the housing 16, the light trap 15 and louver 12 attached thereto can be mounted from either lengthwise side of the housing assembly 130. This "passive" mounting connection is best seen in FIG. 6.

Figure 7A:
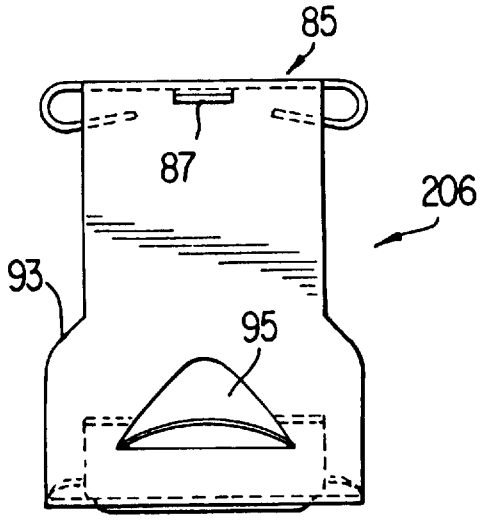
FIGS. 7A through 7C are elevational views of a resilient spring which mounts to the bar of FIG. 8 inclusive.
Figure 7C:
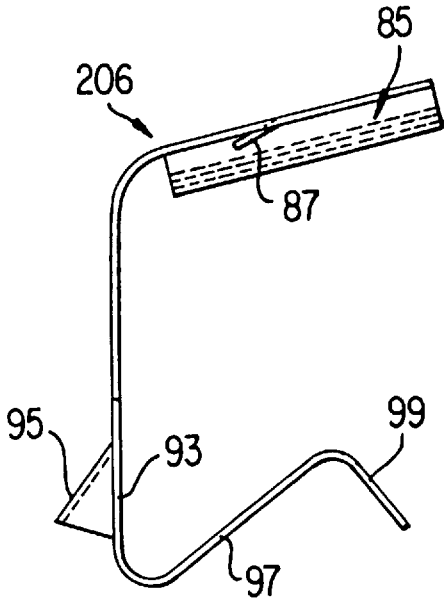
Figure 7B:
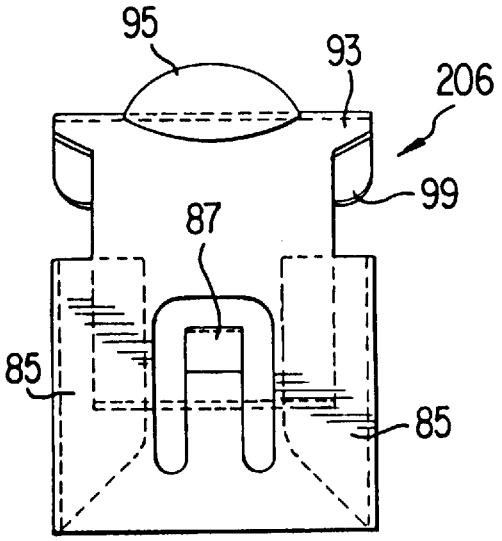
Figure 8A:
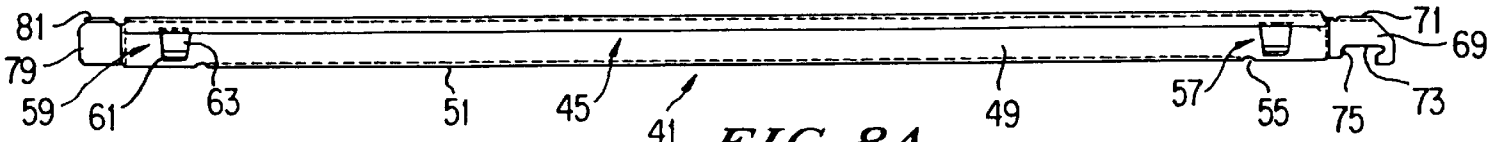
FIGS. 8A and 8B are elevational views of a side structural bar of the light trap.
Figure 8B:
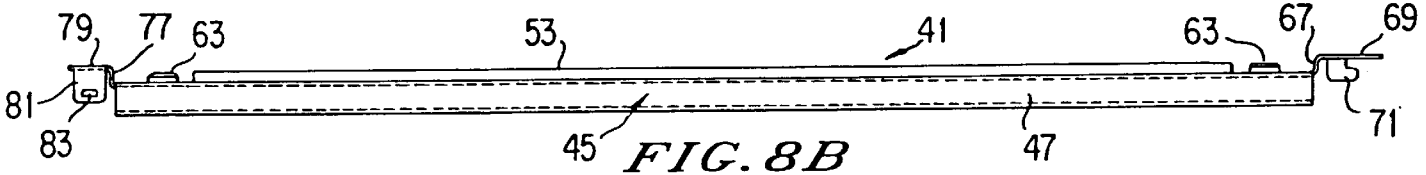
Figure 8C:
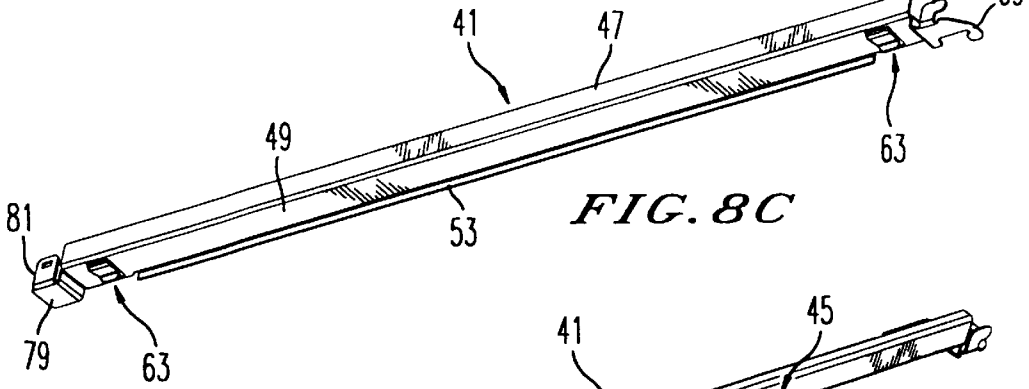
FIGS. 8C and 8D are perspective views of the side structural bar of the light trap.
Figure 8D:
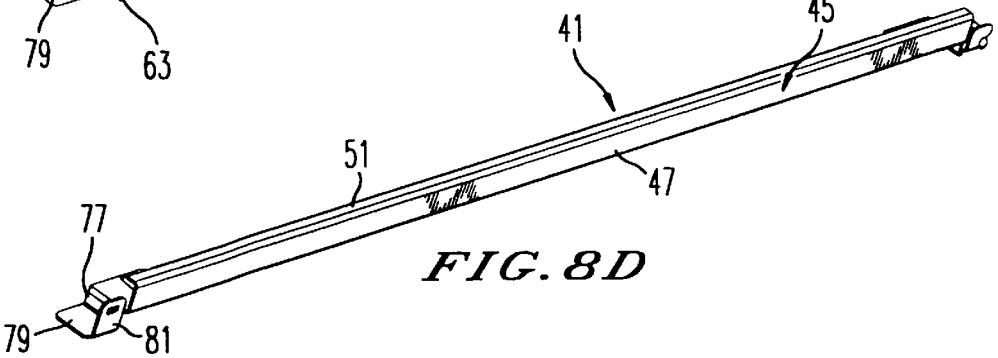
Figure 8E:
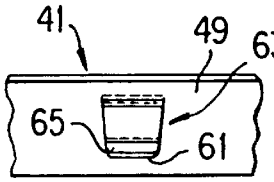
FIGS. 8E through 8G are detail views of the bar of FIG. 8 inclusive.
Figure 8F:
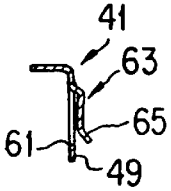
Figure 8G:
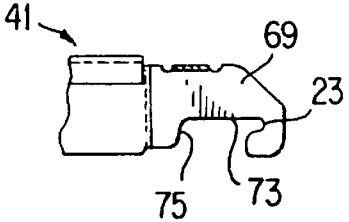

Referring once again to FIGS. 7 inclusive and 8 inclusive in particular, the end 59 of the minor side frame 41 is seen to be formed with a side flange 77 which is substantially identical to the side flange 67 on the end 57. The side flange 77 recurves to form a mounting plate 79 having spring tab 81 extending from a top edge of the plate 79 essentially inwardly of the side frame 41, the spring tab 81 having a rectangular aperture 83 formed therein near the distal edge of said tab 81. The resilient spring 206, seen best in FIG. 7 inclusive, is mounted to the spring tab 81, the spring 206 having a substantially flattened sleeve 85 which slides over the tab 81 with a resilient tongue 87 stamped from U-shaped aperture 91 being bent downwardly at its distal end to be received in to the aperture 83, thereby to hold the resilient spring 206 onto the spring tab 81. The resilient spring 206 bends downwardly from the sleeve 85 and enlarges to form a body portion 93 having a stamped-out arcuate burr 95 formed in said body portion, the body portion 93 then recurving outwardly at an acute angle to the body portion 93 to form lower body portion 97. The distal edge of the lower body portion 97 then recurves to form thumb flange 99 which can be manipulated by hand to bend the resilient spring 206 outwardly to engage/disengage the burr 95 with/from one of the slots 98 formed in the side bar 22 or the side bar 24. Use of the pair of resilient springs attached one each to respective ends of the side frames 41 thus act to releasably lock the light trap and and louver mounting assembly 14 to the housing assembly 130. The operation of this releasable connection is best seen in FIG. 5 inclusive.

The function of the tabs 63 on each of the side frames 41 will be described hereinafter in association with structure which is a part of the major side frames 43. It is to be understood that the side frames 41 can be formed from a single sheet of material such as steel, the side frames 41 typically being painted black which is normally the selected color for the light trap 15. The resilient spring 206 is seen to preferably comprise a separate piece of a material such as spring steel having a greater resiliency than does the thicker material preferably used to form the side frames 41.

Figures 9A, 9B, 10A, 10B:
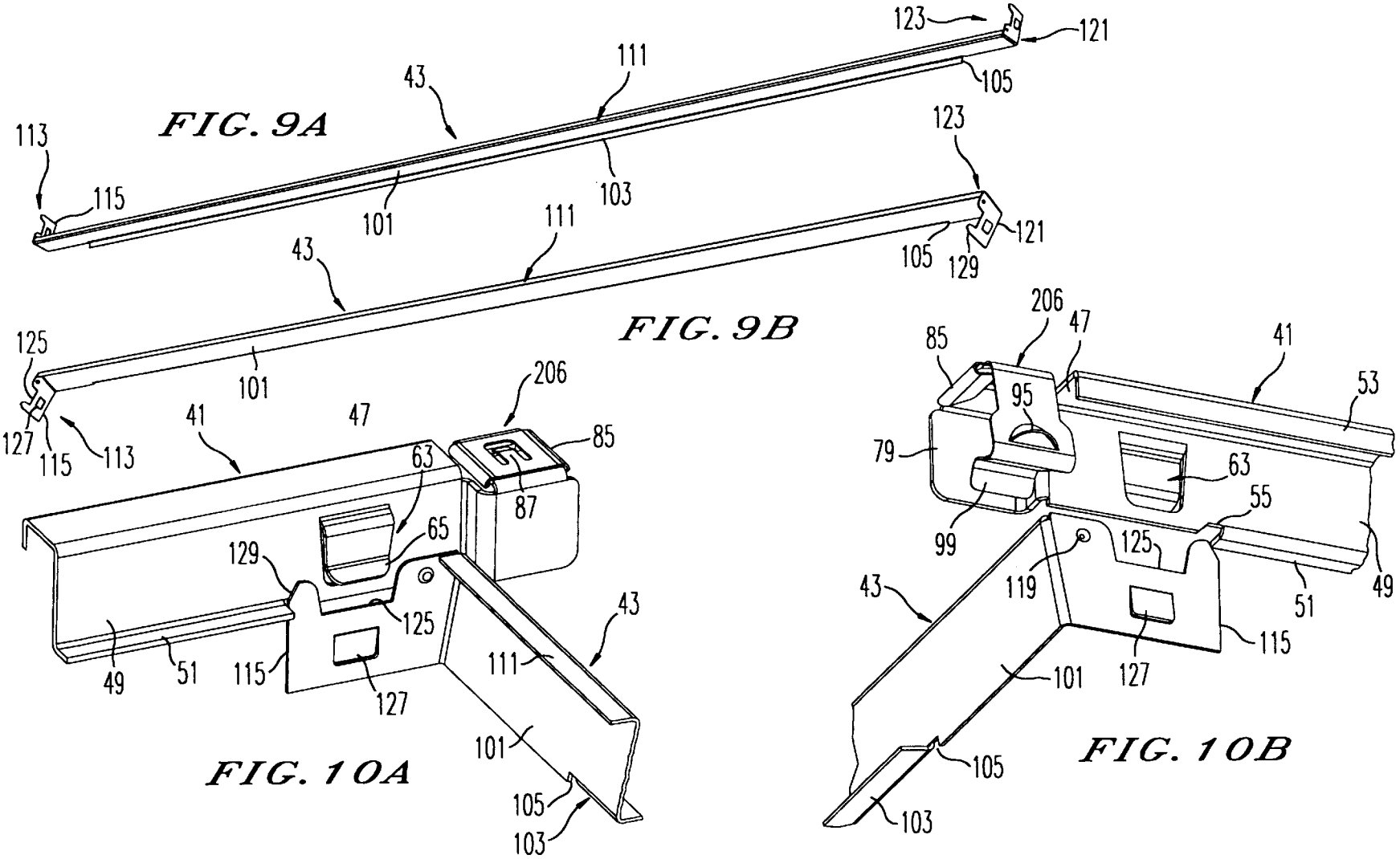
FIGS. 9A and 9B are perspective views of a side bar of the light trap forming the length-wise portion of the light trap and louver mounting assembly.
FIGS. 10A through 10D are detail perspective assembly views of the fitting of the bars of FIGS. 7 inclusive and 9 inclusive at a release juncture thereof.
Figure 10C:
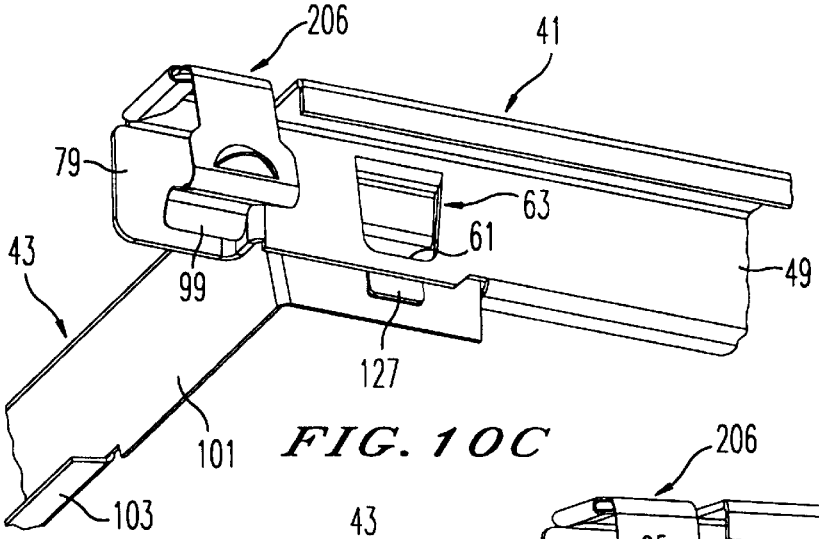
Figure 10D:
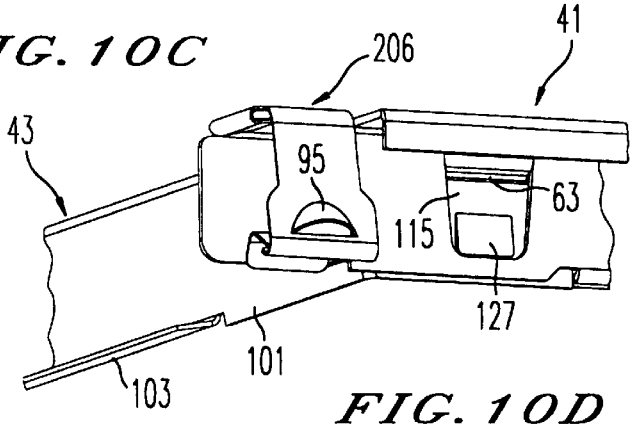
Figure 11A:
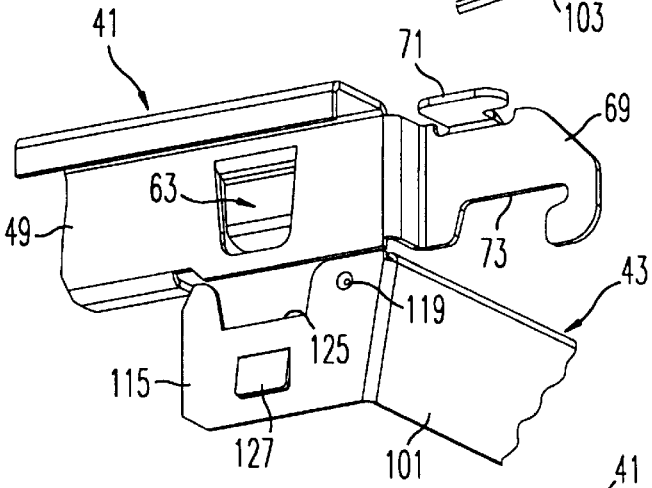
FIGS. 11A and 11B are detail perspective views showing the fitting of the bars of FIG. 7 inclusive and FIG. 9 inclusive from another side thereof.
Figure 11B:
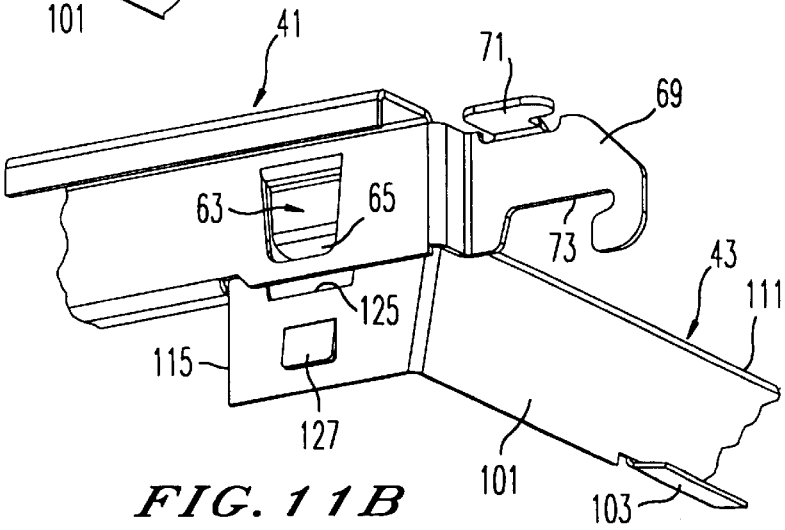
Figure 12:
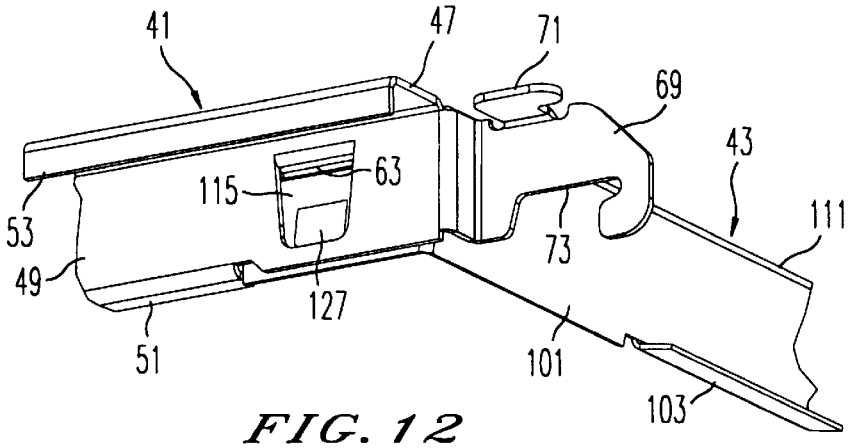
FIG. 12 is a detail perspective view illustrating the assembled relationship of the bars of FIGS. 7 inclusive and 9 inclusive at a passive corner juncture.

Referring now to FIGS. 9A and 9B inter alia, one of the major side frames 43 is shown, the side frames 43 comprising the lengthwise portions of the light trap 15. The major side frames 43 attach to and cooperate with the minor side frames 41 to form the light trap 15, the side frames 41, 43 attaching to the louver 12 as will be described hereinafter to form the light trap and louver mounting assembly 14. Since the major side frames 43 are essentially identical, a description of one will suffice for a description of both. The side frame 43 is seen to be formed from a single sheet of material such as steel and which is then painted a color such as black since the light trap 15 is intended to be a dark color. Of course, the frames 41, 43 can be otherwise colored as desired. The side frame 41 is structurally formed of an elongated planar body portion 101 which is vertically oriented in normal usage of the lighting fixture 10. The lower edge of the body portion 101 has a flange 103 formed along substantial medial portions of this length, the flange 103 being substantially planar and oriented at an angle of 90° relative to the plane of the body portion 101. The flange 103 does not extend the full length of the lower edge of the body portion 101, the flange 103 terminating near each end of said body portion 101, slots 105 being formed in the body portion 101 at the termination of each end of the flange 103. The flange 103 is intended to be received within a channel 107 (seen in FIGS. 13 and 15) formed along lengthwise lateral edges of the louver 12, the channel 107 being formed by the bending back of material forming major side portions of the periphery 109 of the louver 12. The fitting of the flanges 103 of the major side frames 43 into the respective channels 107 of the louver 12 acts to impart substantial rigidity to the louver 12 when the light trap 15 is assembled to the louver 12. The upper edge of the body portion 101 is provided with a flange 111 which extends along the full length of the body portion 101 and extends inwardly of the light trap 15, that is, in a direction opposite to the direction in which the flange 103 extends. The plane within which the flange 111 lies is slightly less than perpendicular to the plane in which the body portion 101 lies. The body portion 101 of the side frame 43 thus angles relative to the vertical in order to facilitate spacing from angled outer wall portions of the louver 12. The longitudinally extending edge of the flange 111 contacts and is held against longitudinally extending outer walls of the louver 12. At end 113 of the body portion 101 an end plate 115 is formed which is oriented substantially vertically and thus is slightly angled relative to the body portion 101. The end plate 115 is provided with an aperture (not shown) which essentially comprises a "paint hanger hole" by which the frame 43 is mounted during painting. An indented dimple 119 is formed in the end plate 115, the dimple 119 contacting an edge of the louver 12 to facilitate maintenance of the side frames 43 in position on the louver 12. A corresponding dimple 119 is formed in end plate 121 at the opposite end 123 of the side frame 43. The end plates 115 and 121 are each provided with an open ended notch 125, a punched-out locking tab 127 being formed in the end plates 115, 117 immediately below the notch 125. The locking tabs 127 cooperate with the opposing tabs 63 formed on each one of the side frames 41 on assembly of said frames 41, 43 together as is best seen in FIGS. 10 through 12. Outermost upper corners 129 of the plates 115, 121 are cut away to facilitate assembly of the light trap 15. The end plate 121 is formed essentially identically to the end plate 15 but without the provision of the "paint hanger hole" (not shown) as described above.

FIGS. 10 through 12 illustrate the fitting of the side frames 41 and side frames 43 together to form the light trap 15. In essence, each of the tabs 63 at both ends of each of the side frames 41 are received over and into engagement with the notches 125 formed in the end plates 115, 121 of each of the side frames 43. This positioning of the respective ends of the frames 41, 43 together causes the locking tabs 127 in each end plate 115, 121 of the frames 43 to fit into respective ones of the U-shaped apertures 61 formed in the side frames 41. Free edges of the locking tabs 27 thus bias against bight edges of the U-shaped apertures 61 and act to hold together in assembled relationship the frames 41, 43 comprising the light trap 15. Since the frames 41 and 43 are fitted about the louver 12 during this assembly, the light trap 15 is thus assembled to the louver 12 to form the light trap and louver mounting assembly 14. The light trap and louver mounting assembly 14 can then be mounted to the housing assembly 130 of the lighting fixture 10 as described herein and in the co-pending United States patent application referred to hereinabove.

The light trap 15 in assembled relationship with the louver 12 acts to block off light leakage from any reasonable line of sight at which the lighting fixture 10 can be viewed in an installation. In assembly of the frames 41, 43 together to form the light trap 15, the light trap and louver mounting assembly 14 is thus formed since the frames 41, 43 are assembled about the louver 12 to attach thereto and to thus hold the louver 12 in a rigid configuration. The louver 12 does not exhibit adequate rigidity without the provision of the light trap 15 mounted thereabout. The structure of the frames 41, 43 acts further to mount the light trap and louver mounting assembly 14 to the housing assembly 130 to complete the mechanical structure of the lighting fixture 10, the light trap 15 of the invention thereby exhibiting multiple connection functions while also providing the function of a light trap per se.

Figure 13:
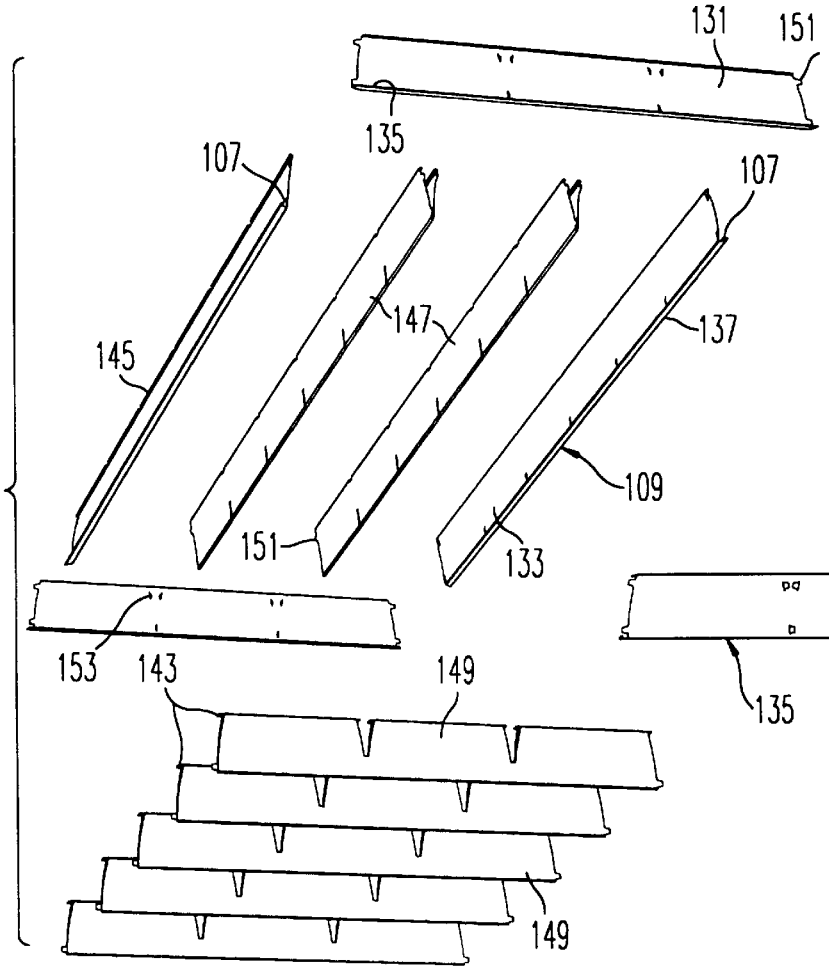
FIG. 13 is an exploded perspective view of louver components.
Figure 14:
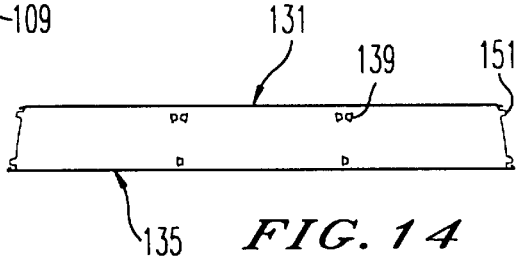
FIG. 14 is an end elevational view of the louver without assembly thereto of the light trap of the invention; and, FIG. 15 is a side elevational view of the louver without assembly of the light trap thereto.
Figure 15:
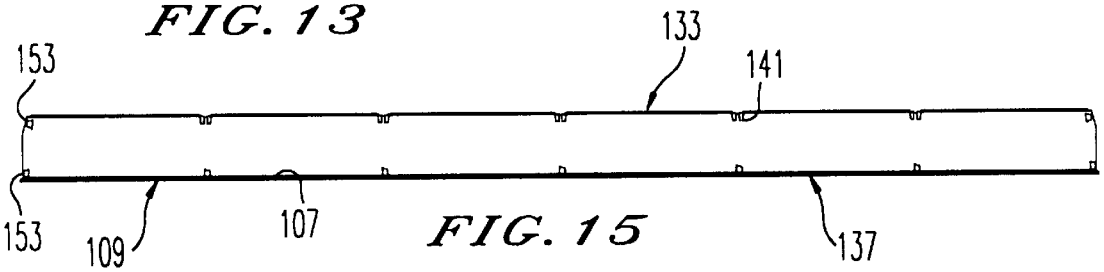

Referring now to FIGS. 13 through 15, the louver 12 is seen to comprise minor end sheets 131 and lengthwise side sheets 133, lower edges 135 and 137 respectively being formed as flanges of said sheets 131, 133. The sheets 131, 133 thus form a frame of the louver 12 and attach together by means of tabs 139 formed on side edges of the sheets 131, which tabs 139 fit into slots 141 formed in the ends of the sheets 133. Upper edges of the sheets 131, 133 are also turned outwardly to form flange-like edges 143 and 145 respectively. The channels 107 are formed as aforesaid to cooperate with the flanges 103 of the frames 43 to facilitate mounting of the light trap 15 to the louver 12. The sheets 131, 133 angle to partially define parabolic shapes provided by cells of the louver 12 such as the cells 48, 50 and 52 described in the co-pending United States patent application referred to hereinabove. Interiorly of the frame provided by the sheets 131, 133, longitudinally extending troffer elements 147 intersect at right angles axial troffer elements 149, the respective troffer elements 147 and 149 being slotted in order that said troffer elements 147, 149 can be interfitted to form the cells of the louver 12. The end sheets 131 are provided with tabs 151 which are received into slots 153 formed in the sheets 131, 133, thereby to attach the sheets 131 together. Tabs 143 formed at upper edges of the troffer elements 149 bend over notches (not shown) formed in flange-like edges of the sheets 131. The mounting together of the sheets 131, 133 and the troffer elements 147, 149 can be accomplished in a variety of ways which are essentially conventional in the art. The component parts of the louver 12 can be conventionally formed of anodized aluminum or of other reflective material such as clear-coated aluminum or other metal in order to provide a desired light performance.

While the invention has been described explicitly in reference to a preferred embodiment thereof, it is to be understood that the invention can be practiced other than as described with the scope of the invention being limited only by the scope of the appended claims.

What is claimed is:

1. A lighting fixture having at least one lamp carried within a housing assembly, comprising:

a louver having a frame defining an outer periphery of the louver;

light trap means carried by the lighting fixture and being mountable about the outer periphery of the louver in abutting relation thereto for minimizing light leakage from the lighting fixture through spaces disposed between the frame of the louver and opposing surfaces of the housing assembly and for mounting the louver for connection to the housing assembly; and, means formed integrally with the light trap means for fastening portions of the light trap means together and for mounting the louver to the housing assembly.

2. The lighting fixture of claim 1 wherein the light trap means comprise a rectangular frame comprising minor side frame elements and major side frame elements, the minor side frame elements each having a hook element formed on one end and a resilient spring carried on the other end thereof, the hook element of each minor side frame element being received into a slot formed in the housing assembly and a portion of each of the resilient springs being received into a slot formed in the housing assembly, thereby allowing snap-fastening of the light trap means to the housing assembly.

3. The lighting fixture of claim 2 wherein the means formed integrally with the light trap means comprise apertures formed in each end of the minor side frame elements and further comprising a tab formed in surmounting relation to and angled relative to the plane of each of the apertures, the major side frame elements having end plates extending substantially at right angles to elongated body portions of each of said major side frame elements, the end plates each having a notch formed in an upper edge thereof, each of the notches receiving one of the tabs formed in the ends of the minor side frame elements, the means formed integrally with the light trap means further comprising a tension tab formed in each of the end plates, each tension tab extending outwardly of the end plate in which said tension tab is formed, each tension tab biasing against bight portions of one of the apertures, thereby to releasably latch the minor and major side frames together.

4. The lighting fixture of claim 1 wherein channels are formed along at least portions of a lower periphery of the louver and the means formed integrally with the light trap means comprise flanged edges formed along edge portions of at least certain portions of the light trap means, portions of the flanged edges being received into portions of the channels.

5. The lighting fixture of claim 4 wherein the light trap means comprise a rectangular frame comprising minor side frame elements and major side frame elements, the major side frame elements having the flanged edges formed integrally therewith and being received into portions of the channels.

6. The lighting fixture of claim 1 wherein the frame of the louver is comprised of side frame elements, longitudinal troffer elements and axial troffer elements, each of said troffer elements having tabs formed at ends thereof and each of the side frame elements having slots or notches formed therein, the tabs extending into the slots or notches and bending to secure the troffer elements to the side frame elements.

7. The lighting fixture of claim 1 wherein the light trap means mount the louver to form a light trap and louver mounting assembly, and further comprising means for mounting the light trap and louver mounting assembly to the housing assembly without the use of separate fasteners.

8. The lighting fixture of claim 7 wherein the means for mounting the light trap and louver mounting assembly to the housing assembly comprises at least one resilient spring carried by the light trap and louver mounting assembly, the housing assembly having at least one slot formed therein, which slot receives a portion of the resilient spring on juxtaposition of the light trap and louver mounting assembly to the housing assembly, the portion of the resilient spring fitting into the aperture to snap-fasten the light trap and louver mounting assembly to the housing assembly.

9. The lighting fixture of claim 8 wherein the resilient spring is formed with a thumb element which when biased by manual pressure away from the aperture causes that portion of the resilient spring received into said slot to be biased outwardly of the slot to release the light trap and louver mounting assembly from the housing assembly.

10. The lighting fixture of claim 1 wherein the light trap means mount the louver to form a light trap and louver mounting assembly, the fastening means mounting the light trap and louver assembly to the housing assembly.

11. A lighting fixture having at least one lamp carried within a housing assembly, comprising:

a louver having a frame defining an outer periphery of the louver;

light trap means mountable to the louver about the outer periphery of the louver in abutting relation thereto for minimizing light leakage from the lighting fixture through spaces disposed between the frame of the louver and opposing surfaces of the housing assembly and for mounting the louver for connection to the housing assembly, the light trap means mounting the louver to form a light trap and louver mounting assembly;

means formed integrally with the light trap means for fastening portions of the light trap means together and for mounting the louver; and, means for mounting the light trap and louver mounting assembly to the housing assembly without the use of separate fasteners.

12. The lighting fixture of claim 11 wherein the means for mounting the light trap and louver mounting assembly to the housing assembly comprises at least one resilient spring carried by the light trap and louver mounting assembly, the housing assembly having at least one slot formed therein, which slot receives a portion of the resilient spring on juxtaposition of the light trap and louver mounting assembly to the housing assembly, the portion of the resilient spring fitting into the aperture to snap-fasten the light trap and louver mounting assembly to the housing assembly.

13. The lighting fixture of claim 12 wherein the resilient spring is formed with a thumb element which when biased by manual pressure away from the aperture causes that portion of the resilient spring received into said slot to be biased outwardly of the slot to release the light trap and louver mounting assembly from the housing assembly.

14. The lighting fixture of claim 11 wherein the light trap means comprise a rectangular frame comprising minor side frame elements and major side frame elements, the minor side frame elements each having a hook element formed on one end and a resilient spring carried on the other end thereof, the hook element of each minor side frame element being received into a slot formed in the housing assembly and a portion of each of the resilient springs being received into a slot formed in the housing assembly, thereby allowing snap-fastening of the light trap means to the housing assembly.

15. The lighting fixture of claim 14 wherein the means formed integrally with the light trap means comprise apertures formed in each end of the minor side frame elements and further comprising a tab formed in surmounting relation to and angled relative to the plane of each of the apertures, the major side frame elements having end plates extending substantially at right angles to elongated body portions of each of said major side frame elements, the end plates each having a notch formed in an upper edge thereof, each of the notches receiving one of the tabs formed in the ends of the minor side frame elements, the means formed integrally with the light trap means further comprising a tension tab formed in each of the end plates, each tension tab extending outwardly of the end plate in which said tension tab is formed, each tension tab biasing against bight portions of one of the apertures, thereby to releasably latch the minor and major side frames together.

16. The lighting fixture of claim 11 wherein channels are formed along at least portions of a lower periphery of the frame of the louver and the means formed integrally with the light trap means comprise flanged edges formed along edge portions of at least certain portions of the light trap means, portions of the flanged edges being received into portions of the channels.

17. The lighting fixture of claim 16 wherein the light trap means comprise a rectangular frame comprising minor side frame elements and major side frame elements, the major side frame elements having the flanged edges formed integrally therewith and being received into portions of the channels.

18. The lighting fixture of claim 11 wherein the frame of the louver is comprised of side frame elements, longitudinal troffer elements and axial troffer elements, each of said troffer elements having tabs formed at ends thereof and each of the side frame elements having slots or notches formed therein, the tabs extending into the slots or notches and bending to secure the troffer elements to the side frame elements.

19. A lighting fixture having at least one lamp carried within a housing assembly, comprising:

a louver;

light trap means mountable to the louver for minimizing light leakage through the louver and for mounting the louver for connection to the housing assembly, the light trap means comprising a rectangular frame comprising minor side frame elements and major side frame elements, the minor side frame elements each having a hook element formed on one end and a resilient spring carried on the other end thereof, the hook element of each minor side frame element being received into a slot formed in the housing assembly and a portion of each of the resilient springs being received into a slot formed in the housing assembly, the light trap means being snap-fastened to the housing assembly; and, means formed integrally with the light trap means for fastening portions of the light trap means together and for mounting the louver.

20. The lighting fixture of claim 19 wherein the means formed integrally with the light trap means comprise apertures formed in each end of the minor side frame elements and further comprising a tab formed in surmounting relation to and angled relative to the plane of each of the apertures, the major side frame elements having end plates extending substantially at right angles to elongated body portions of each of said major side frame elements, the end plates each having a notch formed in an upper edge thereof, each of the notches receiving one of the tabs formed in the ends of the minor side frame elements, the means formed integrally with the light trap means further comprising a tension tab formed in each of the end plates, each tension tab extending outwardly of the end plate in which said tension tab is formed, each tension tab biasing against bight portions of one of the apertures, thereby to releasably latch the minor and major side frames together.

21. The lighting fixture of claim 19 wherein channels are formed along at least portions of a lower periphery of the louver and the means formed integrally with the light trap means comprise flanged edges formed along edge portions of at least certain portions of the light trap means, portions of the flanged edges being received into portions of the channels.

22. The lighting fixture of claim 21 wherein the light trap means comprise a rectangular frame comprising minor side frame elements and major side frame elements, the major side frame elements having the flanged edges formed integrally therewith and being received into portions of the channels.

23. The lighting fixture of claim 19 wherein the louver is comprised of side frame elements, longitudinal troffer elements and axial troffer elements, each of said troffer elements having tabs formed at ends thereof and each of the side frame elements having slots or notches formed therein, the tabs extending into the slots or notches and bending to secure the troffer elements to the side frame elements.

24. The lighting fixture of claim 19 wherein the light trap means mount the louver to form a light trap and louver mounting assembly, and further comprising means for mounting the light trap and louver mounting assembly to the housing assembly without the use of separate fasteners.

25. The lighting fixture of claim 24 wherein the means for mounting the light trap and louver mounting assembly to the housing assembly comprises at least one resilient spring carried by the light trap and louver mounting assembly, the housing assembly having at least one slot formed therein, which slot receives a portion of the resilient spring on juxtaposition of the light trap and louver mounting assembly to the housing assembly, the portion of the resilient spring fitting into the aperture to snap-fasten the light trap and louver mounting assembly to the housing assembly.

26. The lighting fixture of claim 25 wherein the resilient spring is formed with a thumb element which when biased by manual pressure away from the aperture causes that portion of the resilient spring received into said slot to be biased outwardly of the slot to release the light trap and louver mounting assembly from the housing assembly.

* * * * *